US006446292B1

(12) United States Patent
Fuessinger et al.

(10) Patent No.: US 6,446,292 B1
(45) Date of Patent: Sep. 10, 2002

(54) MOBILE BRIDGE AND METHOD OF MAKING SAME

(75) Inventors: Reinhold Fuessinger, Friedrichshafen; Friedrich Graf, Daisendorf, both of (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 09/456,391

(22) Filed: Dec. 8, 1999

(30) Foreign Application Priority Data

Dec. 17, 1998 (DE) ..... 198 58 328

(51) Int. Cl.[7] ..... E01D 15/133
(52) U.S. Cl. ..... 14/2.4; 14/77.1
(58) Field of Search ..... 14/2.4, 2.6, 4, 14/27, 74.5, 77.1

(56) References Cited

U.S. PATENT DOCUMENTS

| | | | | | |
|---|---|---|---|---|---|
| 346,873 | A | * | 8/1886 | Swartz | 14/4 |
| 2,367,291 | A | * | 1/1945 | Tourneau | 14/2.4 |
| 3,811,147 | A | * | 5/1974 | Dix | 14/2.4 |
| 4,017,932 | A | * | 4/1977 | Lotto et al. | 14/2.4 |
| 4,825,492 | A | * | 5/1989 | Zehavi et al. | 14/2.4 |
| 4,912,794 | A | | 4/1990 | Thivans | |
| 4,965,903 | A | * | 10/1990 | Bisch | 14/2.4 |
| 4,972,538 | A | * | 11/1990 | Parramore | 14/2.6 |
| 5,293,658 | A | * | 3/1994 | Huether | 14/2.4 |
| 5,414,885 | A | * | 5/1995 | Berlin et al. | 14/4 |
| 5,423,101 | A | * | 6/1995 | Diefendahl et al. | 14/2.4 |
| 5,491,861 | A | * | 2/1996 | Penuela | 14/4 |
| 5,862,556 | A | * | 1/1999 | Aubert | 14/2.4 |
| 6,023,806 | A | * | 2/2000 | Dumlao et al. | 14/74.5 |

FOREIGN PATENT DOCUMENTS

| | | | | |
|---|---|---|---|---|
| DE | DT1658630 | | 10/1970 | |
| DE | 2907260 | * | 10/1980 | 14/2.4 |
| DE | 3138853 | | 4/1983 | |
| DE | 3138853 A1 | | 4/1983 | |

OTHER PUBLICATIONS

Surespan Portable Bridges, from www.dowco.com/design-net/surespan/fixed.bridges.html, 9/97.*

* cited by examiner

*Primary Examiner*—Thomas B. Will
*Assistant Examiner*—Alexandra K. Pechhold
(74) *Attorney, Agent, or Firm*—Crowell & Moring LLP

(57) ABSTRACT

A lightweight mobile bridge has upper belts and/or lower belts made of composite fiber materials. The belts provide for longitudinal tensile support for vertically extending side walls formed with shear ribs made of metal.

21 Claims, 2 Drawing Sheets

MOBILE BRIDGE AND METHOD OF MAKING SAME

BACKGROUND AND SUMMARY OF THE INVENTION

This application claims the priority of German application 198 58 328.1, filed in Germany on Dec. 17, 1998, the disclosure of which is expressly incorporated by reference herein.

The invention relates to a lightweight mobile bridge with a road deck, upper belts, side walls, and lower belts.

Fiber materials have high rigidity and strength in proportion to their specific density. Because of this property they are of interest for lightweight applications. These materials have considerable advantages when the fibers can be stressed in their lengthwise direction.

Two types of applications of composite fibers in bridge construction are known:

The structure with the exception of the force-introducing hardware is made from composite fibers;

Parts of a structure are replaced by composite fibers.

Extremely strict requirements in terms of weight, dimensions, rigidity, and strength are placed on movable bridges, so that the use of composite fiber materials is advantageous. However, there are two problems with the use of composite fibers. If the total structure is made of composite fiber material, the bridge becomes very expensive. When partial use is made of composite fiber material, many of the advantages of composite fiber construction disappear due to the differing thermal expansion behaviors of metal and composite fibers.

These problems are solved by preferred embodiments of the present invention which provide for a lightweight mobile bridge made of a plurality of bridge sections with a road deck, upper belts, side walls, and lower belts, wherein the road deck is composed of a plurality of transverse plates, wherein the side walls are undulating, and wherein the upper belts and/or the lower belts are made of composite fibers and fastening elements are present, which connect the side walls and belts to each other.

The subject of the invention is a bridge structure that can be implemented in a composite fiber-metal construction. Components in which the use of composite fibers has a relatively minor advantage over metal such as the shear ribs of the side walls are made of metal. Components in which the use of composite fibers is a major advantage, such as the belts of the bridge on which the stress is uniaxial, are made of composite fibers.

In this way, the costs are kept low by the effective use of high-strength composite fibers. The problem of thermal stress that then arises is solved by forming the metal parts of the bridge in such a way that they do not take up any forces in the lengthwise direction.

Other objects, advantages and novel features of the present invention will become apparent from the following detailed description of the invention when considered in conjunction with the accompanying drawings.

DETAILED DESCRIPTION OF THE DRAWINGS

Figure 1:
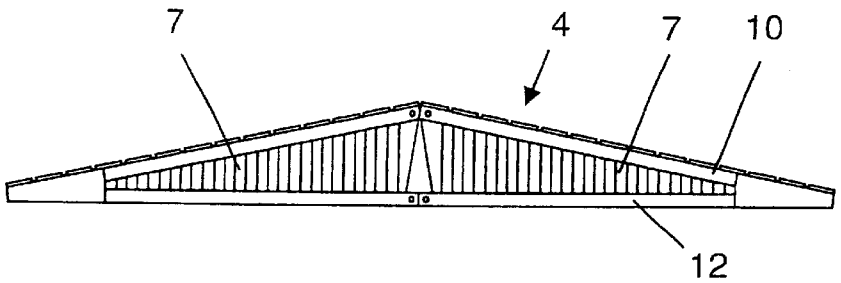
FIGS. 1–3 are side reviews of respective embodiments of bridges according to the invention, composed of bridge ramp sections and/or bridge sections.
Figure 2:
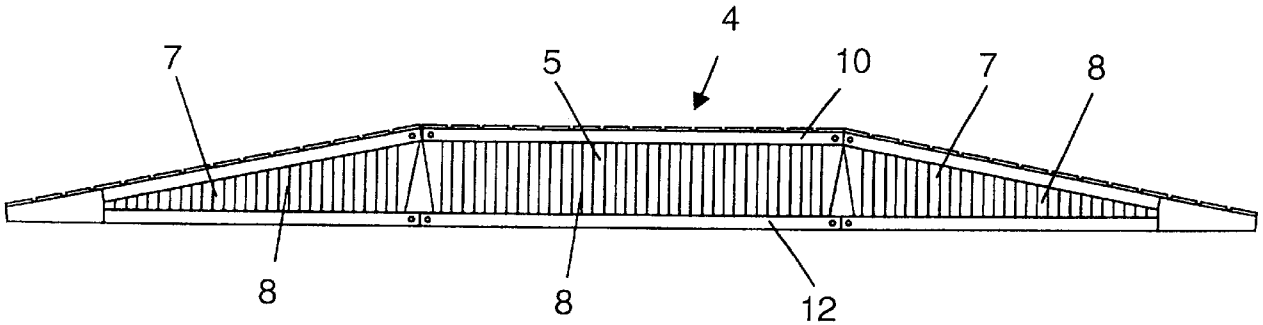
Figure 3:
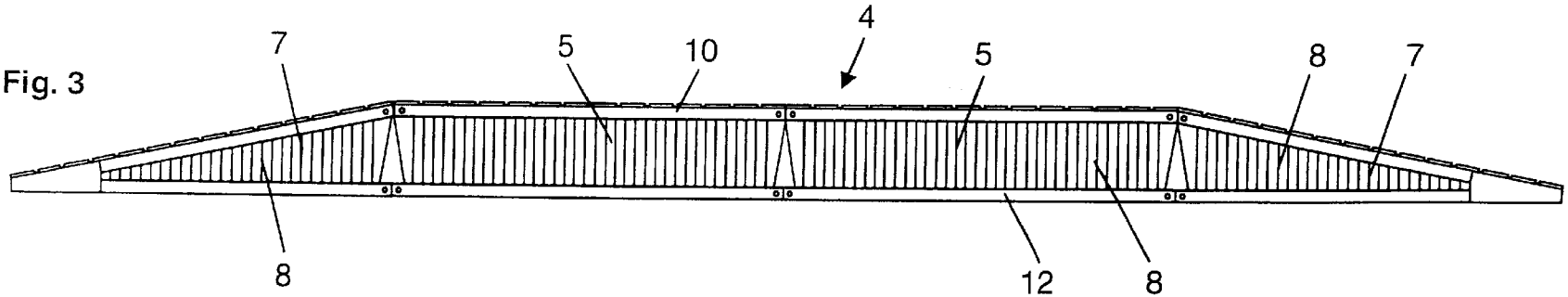
Figure 4:
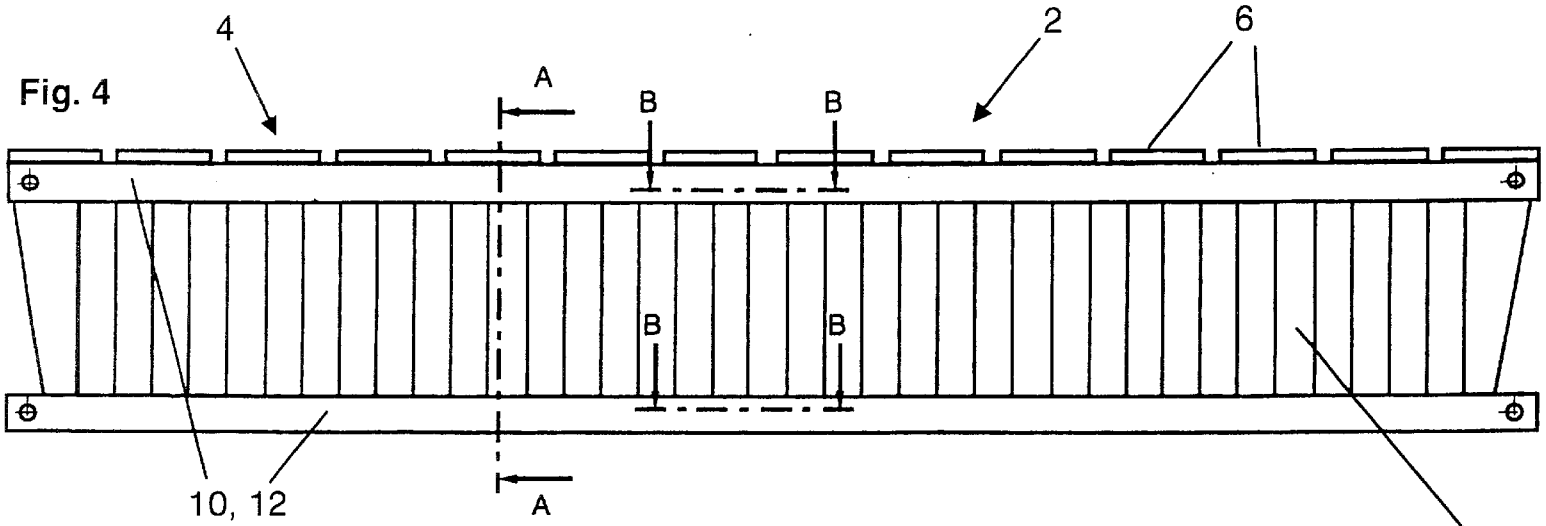
FIG. 4 is an enlarged side view of a bridge section of a bridge constructed according to preferred embodiments of the invention.
Figure 5:
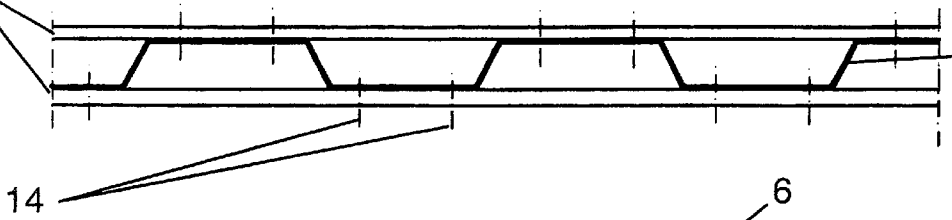
FIG. 5 is an enlarged view taken along section B—B of FIG. 4.
Figure 6:
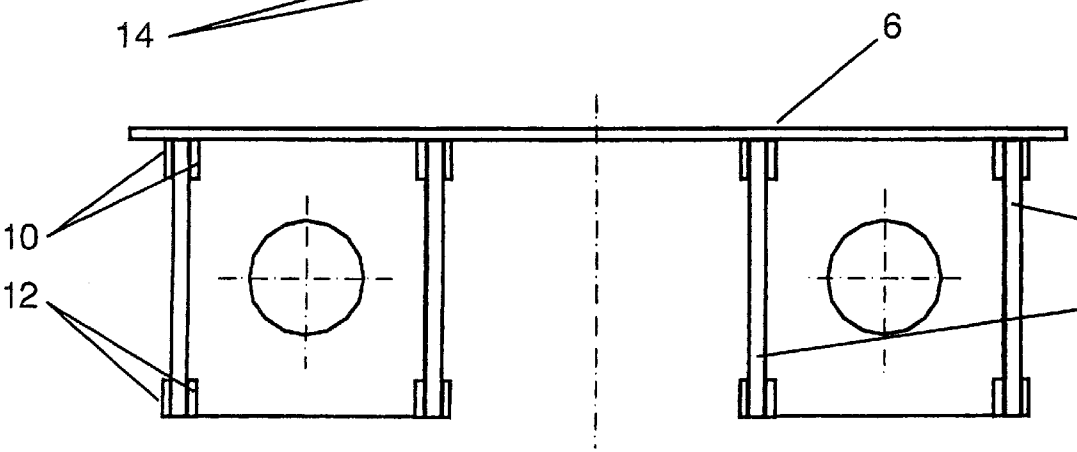
FIG. 6 is a cross section of the bridge along section A—A of FIG. 4.

The bridge 4 shown in FIGS. 1–3 comprises, for transportation reasons, of one or more bridge sections 5 and trapezoidal bridge ramp sections 7 that can be coupled together to form the complete bridge 4.

The road deck 2 of the movable bridge 4 is composed of a plurality of transverse plates 6 that are not linked forcewise in the bridge tension direction. Side walls 8 (shear ribs) of bridge 4 are trapezoidal or undulating in top view so that they function as shear ribs for belts 10, 12, but are unable to transmit lengthwise forces. Upper belt 10 and lower belt 12 are preferably made of composite fibers and attached with fastening elements such as bolts 14 to transfer shear forces to the trapezoidal panel.

This construction ensures that temperature stresses do not cause large forces that could negatively affect the carrying ability and service life of the bridge to build up between the individual components made of different materials.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Lightweight mobile bridge including a plurality of bridge sections connected together when in and in-use assembled condition, each of said bridge sections having a plurality of transverse plates forming a load supporting deck, and sidewalls extending along and supporting respective ends of the transverse plates when in an in-use position, said side walls including:

shear ribs which in-use accept shear forces but are unable to transmit substantial forces in a longitudinal direction of the bridge section, and belts extending in a longitudinal direction of the bridge section and connected with said shear ribs, said belts being operable to accept tension forces in said longitudinal direction, wherein said belts are made of composite fiber materials and said shear ribs are mode of other materials.

2. Mobile bridge according to claim 1, wherein the side walls are trapezoidal in top view.

3. Mobile bridge according to claim 1, wherein the bridge sections are trapezoidal or triangular in side view.

4. Mobile bridge according to claim 2, wherein the bridge sections are trapezoidal or triangular in side view.

5. A mobile bridge according to claim 1, wherein said belts are made of material having different thermal expansion characteristics than the material of the side walls.

6. A mobile bridge according to claim 1, wherein said belts are made of material having different thermal expansion characteristics than the material of the side walls and the material of the plates.

7. Lightweight mobile bridge according to claim 1, wherein said sidewalls are undulating.

8. A bridge section for a mobile bridge formed of a plurality of bridge sections which are in an unassembled condition when being transported and are connected together to form a bridge, said bridge section having a plurality of transverse plates forming a load supporting deck, and sidewalls extending along and supporting respective ends of the transverse plates when in an in-use position, said side walls including:

vertically extending shear ribs which in-use accept shear forces but are unable to accept substantial forces in a longitudinal direction of the bridge section, and belts extending in a longitudinal direction of the bridge section and connected with said shear ribs, said belts being operable to accept tension forces in said longitudinal direction, wherein said belts are made of composite fiber materials and said shear ribs are made of other materials.

9. A bridge section according to claim 8, wherein said shear ribs are made of metal.

10. A bridge section according to claim 9, wherein said shear ribs have a trapezoidal configuration in a top view thereof.

11. A bridge section according to claim 10, wherein said belts include respective pairs of top belts and bottom belts which are connected at respective opposite transverse sides of the shear ribs.

12. A bridge section according to claim 11, wherein said side walls are disposed under the transverse plates when in an assembled in-use position.

13. A bridge section according to claim 8, wherein said side walls are disposed under the transverse plates when in an assembled in-use position.

14. A mobile bridge formed with a plurality of interconnected bridge sections according to claim 8.

15. A mobile bridge according to claim 8, wherein said belts are made of material having different thermal expansion characteristics than the material of the side walls and the material of the plates.

16. A mobile bridge according to claim 8, wherein said belts are made of material having different thermal expansion characteristics than the material of the side walls.

17. A method of making a bridge section for a mobile bridge comprising:

providing at least two side walls with vertically extending shear ribs configured so as not to transmit substantial lengthwise forces, attaching flexible belts to the shear ribs at longitudinally spaced positions, and placing transversely extending bridge traffic supporting plates on top of the side walls with said plates not linked forcewise to one another in a bridge tension direction, wherein the flexible belts are made of composite fiber materials and the shear ribs are made of other less flexible materials.

18. A method according to claim 17, wherein said shear ribs are made of metal.

19. A method according to claim 18, wherein said shear ribs have a trapezoidal configuration in a top view thereof.

20. A method according to claim 17, wherein said belts are made of material having different thermal expansion characteristics than the material of the side walls.

21. A method according to claim 17, wherein said belts are made of material having different thermal expansion characteristics than the material of the side walls and the material of the plates.

* * * * *